US012404875B2

(12) United States Patent
Seibold

(10) Patent No.: US 12,404,875 B2
(45) Date of Patent: Sep. 2, 2025

(54) DEVICE FOR EXCHANGING THERMAL ENERGY WITH AMBIENT AIR

(71) Applicant: Andreas Seibold, Kernen (DE)

(72) Inventor: Andreas Seibold, Kernen (DE)

( * ) Notice: Subject to any disclaimer, the term of this patent is extended or adjusted under 35 U.S.C. 154(b) by 0 days.

(21) Appl. No.: 18/881,869

(22) PCT Filed: Jul. 10, 2023

(86) PCT No.: PCT/EP2023/069075

§ 371 (c)(1),
(2) Date: Jan. 7, 2025

(87) PCT Pub. No.: WO2024/013112

PCT Pub. Date: Jan. 18, 2024

(65) Prior Publication Data

US 2025/0257741 A1 Aug. 14, 2025

(30) Foreign Application Priority Data

Jul. 12, 2022 (DE) ..... 10 2022 117 314.3

(51) Int. Cl.
*H05K 7/20* (2006.01)
*F04D 19/00* (2006.01)
(Continued)

(52) U.S. Cl.
CPC ..... *F04D 29/582* (2013.01); *F04D 19/002* (2013.01); *F04D 29/522* (2013.01); *F04D 29/541* (2013.01)

(58) Field of Classification Search
CPC .... F04D 29/582; F04D 19/002; F04D 29/522; F04D 29/541
(Continued)

(56) References Cited

U.S. PATENT DOCUMENTS 223,300 A * 1/1880 Smethells ..... F04D 29/4226 415/216.1
675,375 A * 6/1901 Davidson ..... F04D 29/628 415/204
(Continued)

FOREIGN PATENT DOCUMENTS

KR 2003036581 A * 5/2003
KR 20030036581 A 5/2003

*Primary Examiner* — Anatoly Vortman
(74) *Attorney, Agent, or Firm* — David Guerra

(57) ABSTRACT

The invention relates to a device for exchanging thermal energy with ambient air, comprising at least one heat exchanger (12; 162, 164; 202) through which an air flow can flow and which is assigned an axial fan (16; 166, 168; 208) for conveying the air flow through the heat exchanger and an outflow housing (40; 170, 172; 210) receiving the air flow, wherein the outflow housing has an air outlet opening (46) for discharging the air flow into the environment. In order to develop the device in such a way that the outflow of the axial fan (16; 166; 168; 208) can be deflected transverse to the outlet direction of the axial fan with minimal flow losses, according to the invention, the outflow housing (40; 170; 172; 210) forms an air-receiving space (41) axially offset to an impeller wheel (24) and a motor (26) of the axial fan (16; 166, 168; 208), which receives the conveyed air flow over the entire cross-section of the impeller wheel (24) and the motor (26) and is penetrated by the fan rotational axis (28), and wherein the outflow housing covers the impeller wheel (24) and the motor (26) when viewed from the rear and is designed and configured to supply the conveyed air flow to the air outlet opening (46) with a directional component tangential to a swirling movement imposed on the air flow by the axial fan.

20 Claims, 11 Drawing Sheets

(51) Int. Cl.

| | |
|---|---|
| ***F04D 29/52*** | (2006.01) |
| ***F04D 29/54*** | (2006.01) |
| ***F04D 29/58*** | (2006.01) |
| ***F24F 5/00*** | (2006.01) |

(58) Field of Classification Search
USPC ..... 361/696
See application file for complete search history.

(56) References Cited

U.S. PATENT DOCUMENTS 2,001,522 A * 5/1935 Chester ..... F04D 27/0253 415/148
2,041,570 A * 5/1936 Reiffenstein ..... F03B 3/186 415/206
2,225,398 A * 12/1940 Hamblin ..... F04D 29/665 415/206
3,019,963 A * 2/1962 Eck ..... F04D 29/30 415/914
3,398,880 A * 8/1968 Wallin ..... F04D 25/166 415/119
4,576,549 A * 3/1986 Lanier ..... F04D 29/4213 415/206
4,712,611 A * 12/1987 Witzel ..... B60H 1/00471 165/DIG. 309
4,867,640 A * 9/1989 Penlesky ..... F04D 29/626 415/214.1
7,813,129 B2 * 10/2010 Van Der Werff ..... G06F 1/20 361/679.48
8,199,485 B2 * 6/2012 Cheng ..... G06F 1/20 361/679.48
10,473,120 B2 * 11/2019 Thawani ..... F04D 29/665
11,078,927 B2 * 8/2021 Watanabe ..... H05K 7/20172
11,729,939 B2 * 8/2023 Russell ..... H05K 7/20154 361/695
2010/0074742 A1 * 3/2010 Koo ..... F04D 29/582 415/204
2012/0181002 A1 * 7/2012 Chen ..... F28F 7/02 165/121
2019/0338784 A1 * 11/2019 Chen ..... F04D 29/4233

* cited by examiner

DEVICE FOR EXCHANGING THERMAL ENERGY WITH AMBIENT AIR

CROSS-REFERENCE TO RELATED APPLICATIONS

This application is an U.S. national phase application under 35 U.S.C. § 371 based upon co-pending International Application No. PCT/EP2023/069075 filed on Jul. 10, 2023. Additionally, this U.S. national phase application claims the benefit of priority of co-pending International Application No. PCT/EP2023/069075 filed on Jul. 10, 2023 and German Application No. 10 2022 117 314.3 filed on Jul. 12, 2022. The entire disclosures of the prior applications are incorporated herein by reference. The international application was published on Jan. 18, 2024 under Publication No. WO 2024/013112 A1.

BACKGROUND

Technical Field

The invention relates to a device for exchanging thermal energy with ambient air, comprising at least one heat exchanger through which an air flow can flow and which is assigned an axial fan for conveying the air flow through the heat exchanger, and an outflow housing receiving the air flow conveyed by the axial fan on the downstream side, wherein the axial fan has a motor and an impeller wheel, with blading, that can be driven by the motor to rotate about an axis of rotation, and wherein the outflow housing has an air outlet opening for discharging the air flow to the environment.

Background Description

Devices with a heat exchanger through which an air flow can flow, an axial fan for conveying the air flow through the heat exchanger and with an outflow housing receiving the air flow conveyed by the axial fan on the downstream side that has an air outlet opening for discharging the air flow to the environment, are used, for example, in heat pumps and air conditioning systems in which the heat exchanger, in heating mode, assumes the function of an evaporator of a coolant flowing through the heat exchanger and, in cooling mode, the function of a condenser.

Such devices are also used in the electronics sector for cooling electronic components, wherein the heat exchanger is designed in the form of a heat sink through which the air flow can flow and on which the electronic components are arranged. In order to apply the air flow conveyed by the axial fan to the heat sink, the axial fan is usually chosen to be large enough that it almost completely covers the surface of the heat sink.

Compared to radial fans, axial fans have the advantage of a large intake area, and thereby enable a uniform flow through the heat exchanger. However, axial fans have the disadvantage that the delivered volume flow decreases even with a moderate increase in back pressure. For this reason, axial fans often have a free outflow, without obstructions. In many cases, however, it is necessary to deflect by 90° the air flow to be discharged into the environment downstream of the axial fan. In order to minimize pressure losses in so doing, the outflow housing often has a box-like shaft whose width corresponds at least to the diameter of the axial fan.

This results in a considerable increase in the size of the device, wherein pressure losses often cannot be avoided despite the considerable size.

With heat pumps for heating buildings or swimming pools, it is often preferred to bury them in the ground rather than install them in the basement or outdoors, due to the space required. In such cases of an outflow housing, the return of the air flow to the environment requires minimal flow resistance, despite strong air deflection, in order to avoid a noticeable reduction in the conveyed volume flow.

In the electronics sector, too, to increase the cooling performance, in particular of high-performance processors, it is advantageous to direct the outflow of the axial fan to an air outlet opening via an outflow housing with a small installation space and minimal pressure loss, and thereby prevent internal backflow—a so-called thermal short circuit.

SUMMARY

The object of the present invention is therefore to develop a device of the type mentioned at the outset in such a way that the outflow of the axial fan can be diverted transversely to the outlet direction of the axial fan with the lowest possible flow losses.

This object is achieved according to the invention in a device of the generic type in that the outflow housing forms an air intake chamber, axially offset from the impeller wheel and from a motor of the axial fan, which receives the conveyed air flow over the entire cross-section of the impeller wheel and the motor and is penetrated by the axis of rotation of the axial fan, wherein the outflow housing covers the impeller wheel and the motor like a hood in a rear view, and wherein the outflow housing is designed and configured to supply the conveyed air flow to the air outlet opening with a directional component tangential to a swirling movement imposed on the air flow by the axial fan.

The device according to the invention has an outflow housing which receives the air flow conveyed by the axial fan on the outflow side and supplies it to an air outlet opening through which the air flow can be released into the environment. The outflow housing forms an air intake chamber, axially offset from the impeller wheel and from the motor of the axial fan, which receives the air flow conveyed by the axial fan over the entire cross-section of the impeller wheel and the motor, and is penetrated by the axis of rotation of the axial fan. In a rear view looking along the axis of rotation, the outflow housing covers the impeller wheel and the motor like a hood. The air flow conveyed by the axial fan can therefore be received by the outflow housing over a large area and consequently with low losses across the entire cross-section of the impeller and the motor.

Under the action of the axial fan, the conveyed air flow is subjected to a swirling movement around the axis of rotation of the axial fan. According to the invention, the air flow is supplied to the air outlet opening with a directional component tangential to the swirling movement. The swirling movement of the air flow is used to deflect the air flow by 90°. Due to the imposed swirl, the air flow, which is supplied to the outflow housing over a large area across the entire cross-section of the impeller wheel and the motor, performs a loop-shaped movement within the hood-like outflow housing and is supplied to the air outlet opening substantially in a tangential direction. This creates a parallel flow in the region of the air outlet opening, which evenly fills the entire cross-section of the air outlet opening, with the air flow showing hardly any residual swirl. The deflection of the air flow therefore occurs with very low flow losses.

Compared with a conventional 90° pipe bend with an outlet diameter that corresponds to the diameter of the impeller wheel of the axial fan, the size of the outflow housing can be kept significantly smaller; in particular, the extension of the outflow housing in the axial direction relative to the axis of rotation can be significantly reduced, such that the device according to the invention has a very compact design. In addition, a much more uniform velocity distribution of the air flow can be created in the region of the air outlet opening, which can further reduce pressure losses.

The axial extension of the discharge housing can, for optimum flow, be adapted to the existing ratio of swirl to axial velocity of the air flow, which depends upon the utilized impeller wheel blading and the selected operating point of the axial fan. The size of the air outlet opening influences the exit speed of the air flow. An increase in size causes a diffuser effect, i.e., a slowing down of the air flow. A reduction in size creates a jet effect and therefore an acceleration of the air flow. For example, the exit speed can be chosen to be just large enough to safely avoid backflow to the inlet of the heat exchanger and therefore a thermal short circuit. This enables very high energy efficiency of the device according to the invention.

Preferably, the air outlet opening is arranged downstream of the axial fan in a region, laterally offset from a center plane of the axial fan, of the outflow housing, wherein the center plane is aligned coaxially with the axis of rotation of the axial fan, and wherein the blading of the impeller rotates in this laterally offset region in a rear view of the outflow housing towards the air outlet opening. In a rear view of the outflow housing looking along the axis of rotation, the center plane of the axial fan divides the impeller into two halves. The air outlet opening is arranged downstream of the axial fan on that side of the center plane on which the blading of the impeller rotates when rotating about the axis of rotation in the rear view of the outflow housing towards the air outlet opening. As a result, the air flowing on this side of the center plane moves basically in a tangential direction to the air outlet opening, and the air flowing on the opposite side of the center plane moves within the hood-like outflow housing in a looping motion towards the air outlet opening. This creates a parallel flow in the air outlet opening, which evenly fills practically the entire cross-section of the air outlet opening and has practically no residual swirl.

In a preferred embodiment of the invention, the extent of the air outlet opening transverse to the axis of rotation is a maximum of 1.9 times the outer radius of the impeller wheel. This helps to feed the air flow substantially in a tangential direction to the air outlet opening.

It is advantageous if the extension of the air outlet opening transverse to the axis of rotation is at least 0.5 times the outer radius of the impeller wheel. In such an embodiment of the invention, the air flow is accelerated in the region of the air outlet opening and released into the environment at a higher speed. This makes it particularly reliable for counteracting backflow to the inlet of the heat exchanger and therefore a thermal short circuit.

It is advantageous if the outflow housing has an air outlet nozzle that defines the air outlet opening. The air outlet opening can be aligned in a tangential direction with respect to the swirling movement of the air flow, in order to generate a particularly uniform parallel flow and to keep flow losses particularly low.

It can be provided that the air outlet nozzle widen or taper in the direction of flow. A widening leads to a diffuser effect, i.e., a slowing down of the flow, and a tapering leads to a nozzle effect and therefore to an acceleration of the flow. The choice of a widening or tapering of the air outlet nozzle therefore makes it possible to specify the speed at which the air flow is released into the environment.

In a preferred embodiment of the invention, the outflow housing has a rear wall opposite the axial fan, which has at least one rear wall section inclined to the axis of rotation of the axial fan, over which the distance of the rear wall to the axial fan increases. In this case, it is advantageous if the at least one rear wall section, which is inclined to the axis of rotation, is arranged on the side of a central plane, aligned coaxially with the axis of rotation, on which the flowing air rotates in a loop-shaped movement. In the direction of rotation, there is an increase in the mass flow due to the continuous supply of air from the axial fan. In order to counteract a resulting increase in the flow velocity, an increase in the flow cross-section of the air flow can, with the aid of at least one rear wall section over which the distance of the rear wall to the axial fan increases, be achieved, in order to thereby counteract an increase in the flow velocity. This can reduce flow losses.

It is advantageous if the outflow housing has a side wall running in the circumferential direction. This allows an additional reduction in flow losses and avoids dirt deposits within the outflow housing.

It is particularly advantageous if the side wall of the outflow housing widens with increasing distance to the axial fan. The side wall thereby forms a kind of cone that opens in the direction facing away from the axial fan.

It is advantageous if the side wall continuously transitions into a rear wall of the outflow housing via a rounding. The rounding can vary in its radius, i.e., it can narrow or widen. The rounding supports the low-loss deflection of the air flow towards the air outlet opening.

It is particularly advantageous if the rear wall widens in a spiral shape in the circumferential direction. The spiral-shaped widening enables a particularly low-loss supply of the air flow to the air outlet opening by deflecting the air flow by 90°, wherein an increase in the speed of the air flow can be counteracted, despite the volume flow from the impeller wheel increasing linearly in the circumferential direction.

In an advantageous embodiment of the invention, the axial fan has a housing which defines an inflow channel and an outflow channel, wherein the inflow channel is arranged upstream of the impeller wheel, and the outflow channel surrounds the impeller wheel in the circumferential direction. The air flow can be supplied to the impeller wheel via the inflow channel. The inflow channel can be connected directly to the heat exchanger. The outflow channel surrounds the impeller wheel and, in combination with the blading of the impeller wheel, defines the air flow on the downstream side of the axial fan.

It is advantageous if the inflow channel extends to a bulkhead that has an opening to which the outflow channel is connected. The bulkhead makes it possible to separate the inflow side of the axial fan from its outflow side in order to thereby avoid an internal backflow and therefore a thermal short circuit.

In an advantageous embodiment of the invention, the outflow channel forms a constriction, adjacent to the opening in the bulkhead, to which an annular wall is connected. The constriction results in a reduction in the flow cross-section of the air flow and therefore an increase in its speed, i.e., the constriction forms an inlet nozzle. The annular wall in combination with the blading of the impeller wheel defines the axial movement of the air flow. The annular wall is preferably cylindrical or conical.

It can be provided that the outflow housing be connected to the bulkhead of the fan housing and surround the outflow channel of the fan housing in the circumferential direction. In such a design, the fan housing dips into the outflow housing.

It is advantageous if the heat exchanger is designed to be flat, and the axis of rotation of the axial fan is aligned obliquely to the heat exchanger. The oblique alignment of the axis of rotation supports the low-loss deflection of the air flow towards the air outlet opening.

In a preferred embodiment of the invention, the axis of rotation of the axial fan is aligned at a maximum angle of 30°, in particular 5° to 10°, to the surface normal of the heat exchanger.

In an advantageous embodiment of the invention, the outflow housing has a flow guide element which is directed radially inwards with respect to the axis of rotation of the axial fan and which is arranged in the transition region between an air outlet nozzle and a side wall of the outflow housing. The flow guide element allows the volume flow to be discharged to be separated from the loop-shaped circulating volume flow in a structurally simple manner. This improves the parallel flow in the region of the air outlet opening.

The flow guide element can, for example, be designed like a tongue.

It can be provided that the device according to the invention have a single heat exchanger to which an axial fan and an outflow housing are assigned, wherein, by means of the axial fan, an air flow can be generated which flows through the heat exchanger and which can be discharged to the environment via the air outlet opening of the outflow housing.

Alternatively, it can be provided that the device according to the invention have a plurality of heat exchangers, in particular two heat exchangers, each of which is assigned an axial fan and an outflow housing, wherein the air flows conveyed by the axial fans can be fed via the air outlet openings of the outflow housings to a common air outlet channel, via which the air flows can be discharged to the environment, wherein the air outlet openings are aligned obliquely to one another. For example, it can be provided that the device have two heat exchangers arranged one above the other or next to the other, through each of which can flow an air flow generated by an axial fan assigned to the respective heat exchanger, wherein the air flow can be fed to an outflow housing from which the air flow can be fed to the common air channel via the respective air outlet opening. The air outlet openings of the outflow housings can each be defined by an air outlet nozzle, wherein the air outlet nozzles of the two outflow housings are aligned at an angle to each other.

It is particularly advantageous if the two outflow housings are designed identically and are aligned in different ways with respect to the common air outlet channel. When the device is mounted, the two outflow housings can be rotated into a specific rotational position relative to the respective fan axis of rotation, so that their air outlet nozzles open into the common air outlet channel.

It is advantageous if the outflow housing is mounted on a base plate of the axial fan so as to rotate about its axis of rotation.

The invention also relates to the use of the device explained above in a heat pump or air conditioning system or for cooling electronic components.

BRIEF DESCRIPTION OF THE DRAWINGS

The following description of preferred embodiments of the invention serves to explain in more detail, in conjunction with the drawing. In the figures.

DETAILED DESCRIPTION OF THE EMBODIMENTS

Figure 1:
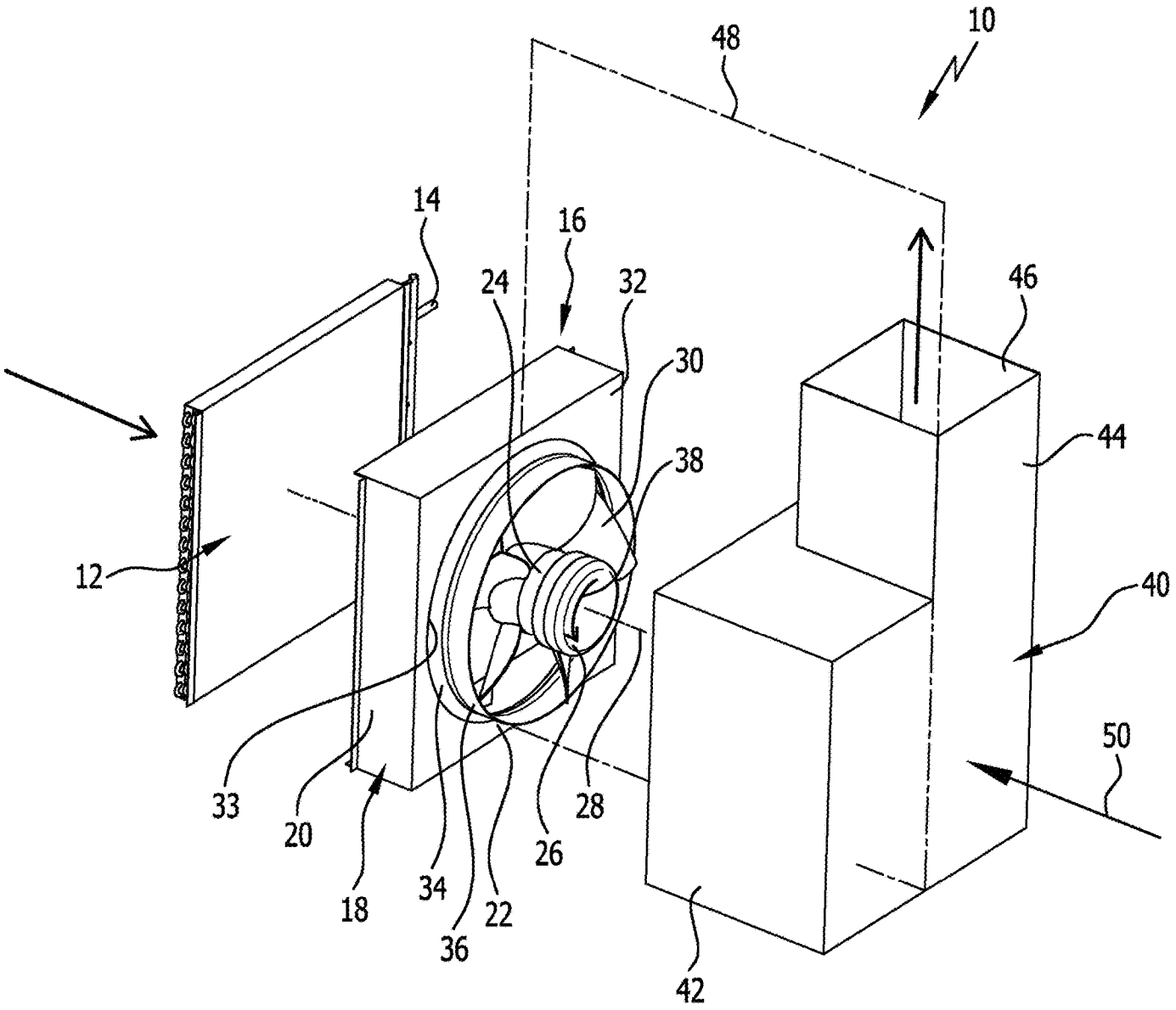
FIG. 1 shows an exploded view of a first embodiment of a device for exchanging thermal energy with the ambient air.

In FIG. 1, a first advantageous embodiment of a device according to the invention for exchanging thermal energy with the ambient air is shown schematically in an exploded view and is designated overall by reference sign 10. The device 10 has a conventional flat heat exchanger 12 with a fluid line 14 through which a fluid can flow in order to heat or cool the fluid, wherein an exchange of thermal energy with the ambient air takes place. For this purpose, an air flow generated by an axial fan 16 can pass through the heat exchanger 12. The axial fan 16 is connected to the heat exchanger 12 in the flow direction of the air flow and has a fan housing 18 which forms an inflow channel 20 rectangular in cross-section and an outflow channel 22 circular in cross-section. In addition, the axial fan 16 has an impeller wheel 24 which can be made to rotate by a motor 26 about an axis of rotation 28. The impeller wheel 24 has a blading 30 formed from a plurality of blades for conveying the air flow. The impeller wheel 24 is rotatably mounted in the outflow channel 22, and the inflow channel 20 is arranged upstream of the impeller wheel 24.

Starting from the heat exchanger 12, the inflow channel 20 extends to a bulkhead 32 which has an opening 33 to which a constriction 34 of the outflow channel 32 is connected. The constriction 34 forms an inlet nozzle. The constriction 34 is followed by an annular wall 36 of the outflow channel 32, which surrounds the impeller wheel 24 in the circumferential direction. Looking at the motor 26, the impeller wheel 24 rotates counterclockwise. The direction of rotation of the impeller wheel 24 is illustrated in FIG. 1 by the arrow 38.

The device 10 also has an outflow housing 40 which is connected to the axial fan 16 in the flow direction of the conveyed air flow and receives on the outflow side the air flow conveyed by the axial fan 16.

The outflow housing 40 is designed in the manner of a hood, which forms an air intake chamber 41 axially offset from the impeller 24 and the motor 26 and through which the rotation axis 28 passes. In a rear view looking along the axis of rotation 28, the outflow housing 40 covers the impeller wheel 24 and the motor 26, the motor axis (not shown in the drawing) of which is aligned coaxially with the axis of rotation 28. The outflow housing receives the air flow conveyed by the axial fan 16 over a large area across the entire cross-section of the impeller wheel 24 and the motor 26.

Figure 2:
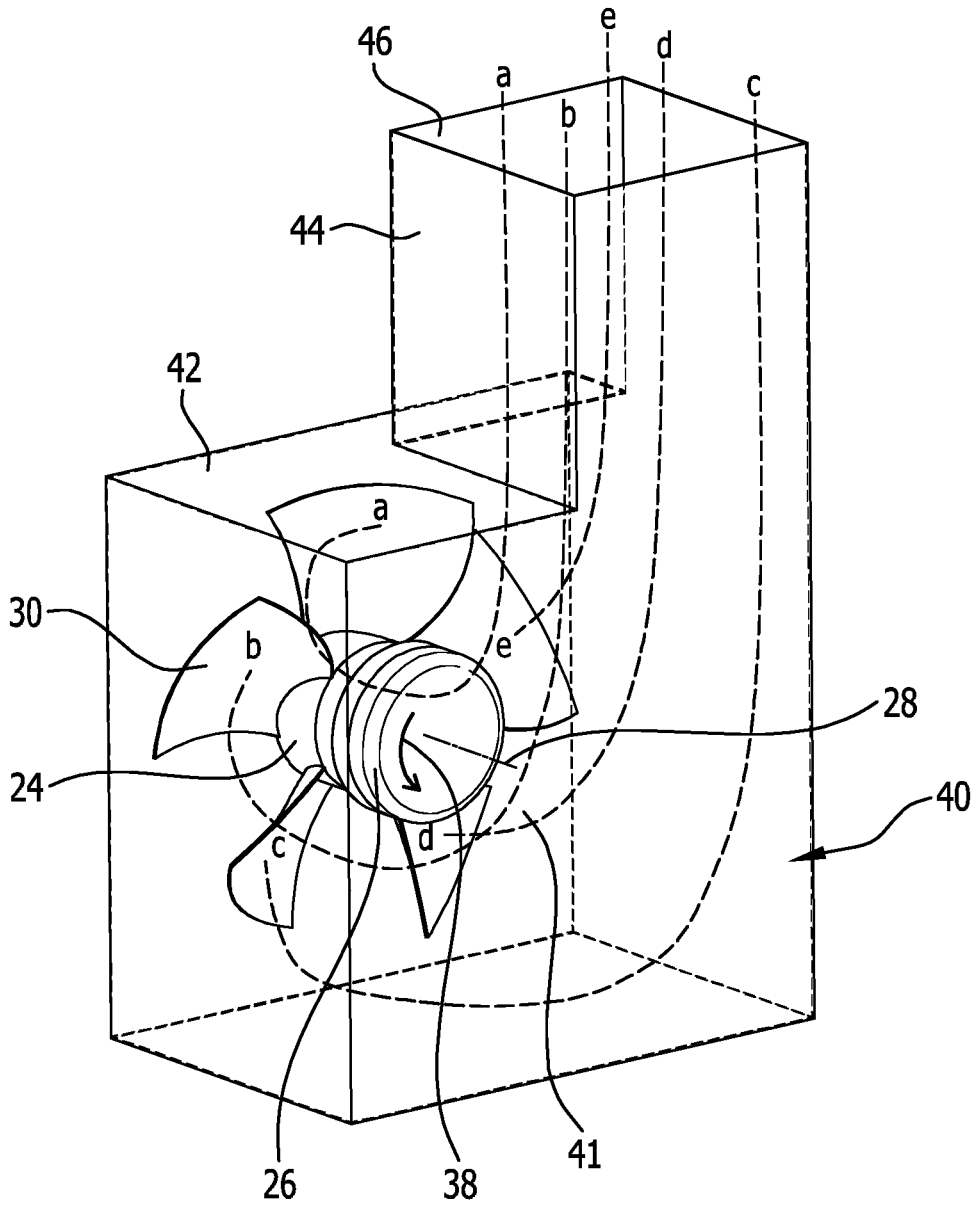
FIG. 2 shows a perspectival view of an outflow housing of the device from FIG. 1 with exemplary flowlines of an air flow.

The outflow housing 40 is shown enlarged in FIG. 2 together with the impeller wheel 24 and the motor 26. The outflow housing 40 has a cuboid-shaped housing body 42 which rests against the bulkhead 32 and surrounds the outflow channel 22 as well as the impeller wheel 24 and the motor 26.

An air outlet nozzle 44 is connected to the top of the housing body 42 and defines an air outlet opening 46 of the outflow housing 40. The air flow conveyed by the axial fan 16 can be discharged into the environment via the air outlet opening 46.

The air outlet nozzle 44 and the air outlet opening 46 are arranged in a region laterally offset from a center plane 48, shown in dash-dotted lines, of the outflow housing 40, wherein the center plane is coaxial with the axis of rotation 28 and is aligned vertically in the illustrated position of use of the device 10, and wherein the blading 30 of the impeller wheel 24 rotates in this laterally offset region in a rear view of the outflow housing 40 towards the air outlet opening 46. The viewing direction in the rear view is illustrated in FIG. 1 by the arrow 50.

Under the action of the axial fan 16, the conveyed air flow is subjected to a swirling movement around the axis of rotation 28. The arrangement of the air outlet nozzle 44 and the air outlet opening 46, laterally offset from the center plane 48, and the blading 30, rotating in this laterally offset region in a rear view of the outflow housing 40 relative to the air outlet opening 46, of the impeller wheel 24 results in the air flow, conveyed by the axial fan 16, in this laterally offset region being fed to the air outlet opening 46 substantially in a tangential direction with respect to the swirling movement. On the side, facing away from the air outlet nozzle 44 and the air outlet opening 46, of the center plane 48, the air flow executes a loop-shaped movement and then flows in a substantially tangential direction towards the air outlet opening 46. This creates a parallel flow in the air outlet nozzle 44, which evenly fills the entire cross-section of the air outlet nozzle 44 and hardly has any residual swirl. To illustrate the air flow in the region of the outflow housing 40, some flowlines a, b, c, d, and e are shown in dashed lines in FIG. 2 as examples.

The device 10 therefore makes it possible to guide an air flow through the heat exchanger 12 in an axial direction relative to the axis of rotation 28 and to divert the air flow in the outflow housing 40 by 900 using the swirling movement caused by the axial fan 16, wherein the diversion is associated with very low flow losses, and the air flow in the region of the air outlet opening 46 substantially forms a parallel flow. The low-loss deflection of the air flow within the outflow housing 40 is achieved even though the extension of the outflow housing 40 in the axial direction, i.e., its installation depth, is smaller than the extension of the outflow housing 40 transverse to the axis of rotation 28. The device 10 therefore enables a low-loss deflection of the air flow by 90°, wherein the device 10 has a compact design. The installation depth of the outflow housing 40 can, for a particularly low-loss deflection of the air flow, be adapted to the existing ratio of swirl to axial velocity of the air flow, which depends upon the blading 30 used for the impeller wheel 24 and the selected operating point of the axial fan 16.

Figure 3:
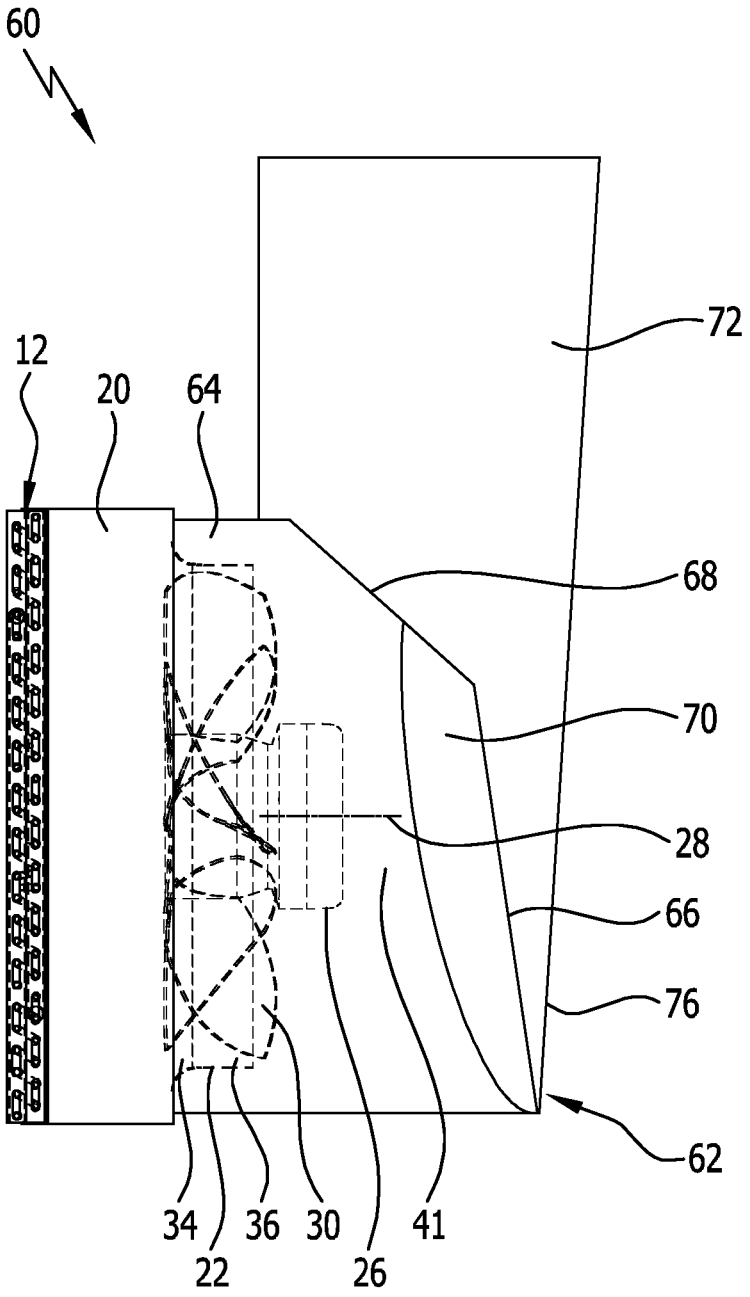
FIG. 3 shows a side view of a second embodiment of a device for exchanging thermal energy with the ambient air.
Figure 4:
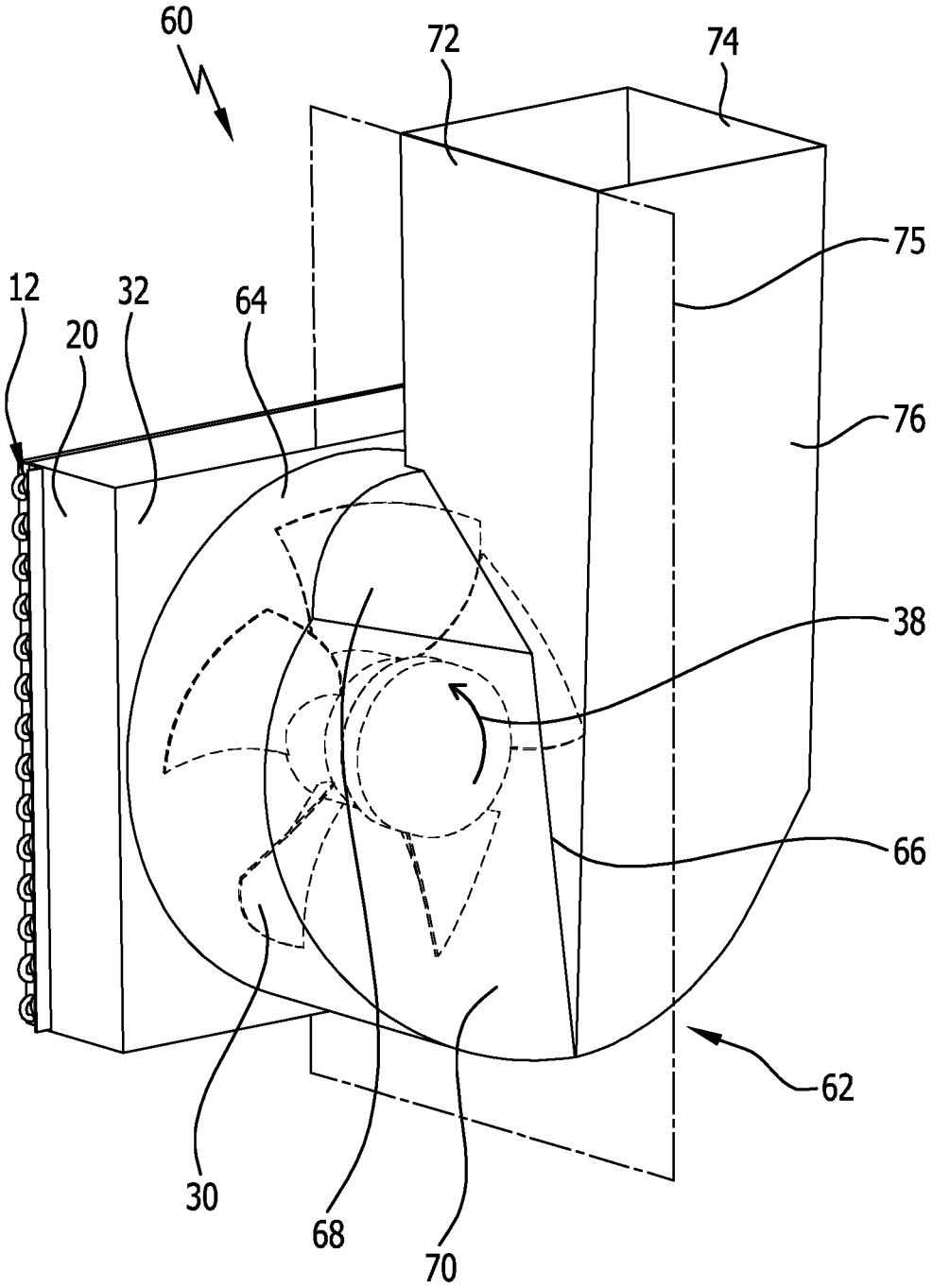
FIG. 4 shows a perspectival view of the device from FIG. 3.
Figure 5:
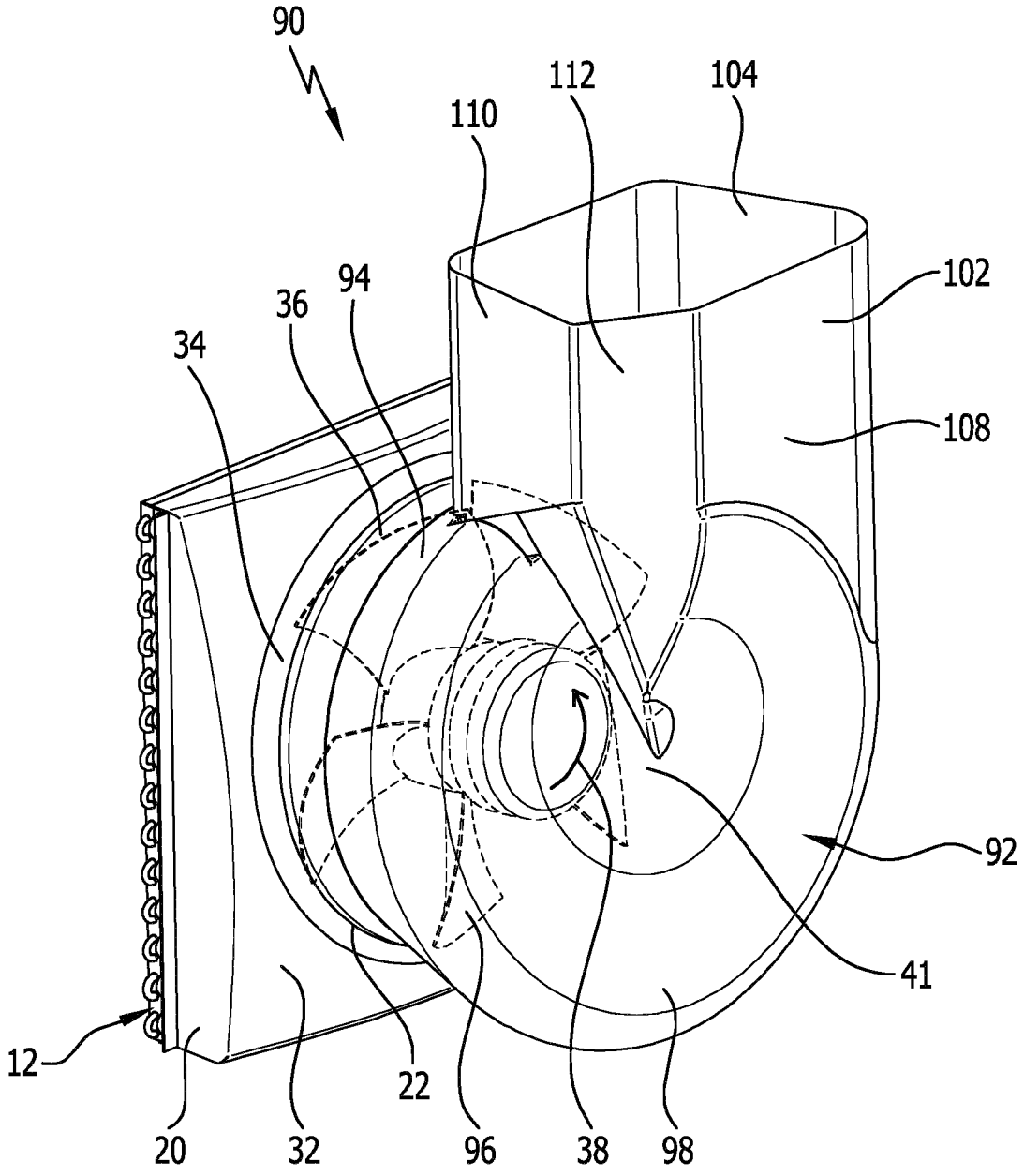
FIG. 5 shows a perspectival view of a third embodiment of a device for exchanging thermal energy with the ambient air.
Figure 6:
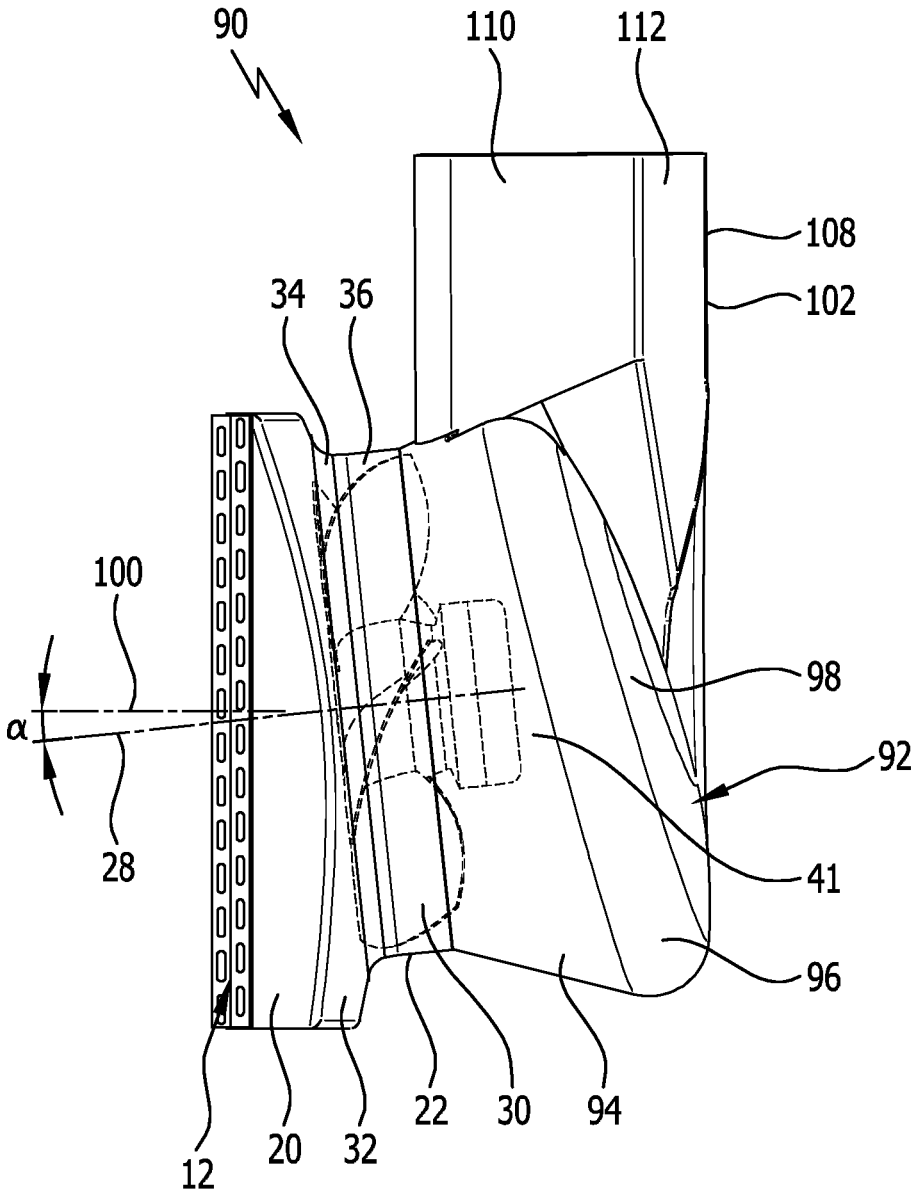
FIG. 6 shows a side view of the device from FIG. 5.

FIGS. 3 and 4 schematically show a second advantageous embodiment of a device according to the invention for exchanging thermal energy with the ambient air, wherein the device as a whole is designated by reference sign 60. For identical components, the same reference signs are used in FIGS. 3 and 4, as well as in FIG. 5 to 13 explained in more detail below, as in FIGS. 1 and 2. To avoid repetition, reference is made to the previous explanations regarding these components.

The device 60 shown in FIGS. 3 and 4 differs from the device 10 shown in FIGS. 1 and 2 by a hood-like outflow housing 62 which has a cylindrical side wall 64 which surrounds the outflow channel 22 as well as the impeller wheel 24 and the motor 26 of the axial fan 16 in the circumferential direction and extends in the axial direction from the bulkhead 32 of the axial fan 16 to a rear wall 66, opposite the axial fan 16, which has a first flat rear wall section 68 inclined to the axis of rotation 28 and a second flat rear wall section 70 inclined to the axis of rotation 28, over which the distance of the rear wall 66 to the axial fan 16 increases in each case. The two rear wall sections 68, 70 are connected to an air outlet nozzle 72 of the outflow housing 62.

The air outlet nozzle 72 defines an air outlet opening 74 and, in a manner corresponding to the air outlet nozzle 44, explained above with reference to FIGS. 1 and 2, is arranged laterally offset from a center plane 75 aligned coaxially with the axis of rotation 28. The center plane 75 is shown in FIG. 4 in dash-dotted lines. The first rear wall section 68 and the second rear wall section 70 are positioned on the side, opposite the air outlet nozzle 72, of the center plane 75. The air outlet nozzle 72 extends with a nozzle rear wall 76 to the lower end of the outflow housing 62, wherein the nozzle rear wall 76 is inclined backwards in the side facing away from the axial fan 16 so that the flow cross-section of the air outlet nozzle 72 continuously expands in the flow direction.

Via the obliquely aligned rear wall sections 68, 70, the internal volume of the outflow housing 62 expands on the side of the central plane 75, on which the flowing air executes a loop-shaped movement, wherein, in this region, the volume flow continuously increases in the circumferential direction due to the air continuously conveyed by the impeller wheel 24. In order to achieve a substantially constant flow velocity despite the increase in the volume flow, the obliquely aligned rear wall sections 68, 70 are used, which cause an expansion of the internal volume of the outflow housing 62 in this region. On the side, opposite the rear wall sections 68, 70, of the center plane 75, the blading 30 of the impeller wheel 24 rotates in a rear view of the outflow housing 62 towards the air outlet opening 74, so that the air flow is supplied to the air outlet opening 74 substantially in a tangential direction with respect to the swirling movement of the air flow, as has already been explained above with reference to FIGS. 1 and 2. The flow cross-section of the air outlet nozzle 72 continuously increasing in the flow direction acts as a diffuser which slows down the flow.

The device 60 therefore enables, with a very compact design, a low-loss deflection of the air flow by 90°.

FIG. 5 to 8 schematically show a third advantageous embodiment of a device according to the invention for exchanging thermal energy with the ambient air, wherein the device as a whole is designated by reference sign 90. The device 90 has a hood-like outflow housing 92 which, in contrast to the outflow housings 62 and 40 explained above, does not directly adjoin the bulkhead 32 of the axial fan 16, but, rather, the outflow housing 92 adjoins the outflow channel 22 of the axial fan 16, wherein it has a side wall 94 which is adjacent to the outflow channel 22 and which continuously widens with increasing distance from the axial fan 16 and which continuously merges, via a rounding 96, into a rear wall 98 spirally widening in the circumferential direction.

In the device 90, the axial fan 16 is inclined to the heat exchanger 12, i.e., the axis of rotation 28 of the axial fan 16 is inclined at an angle $\alpha$ of at most 30°, in particular at an angle $\alpha$ of 5 to 10°, to the surface normal 100 of the flatly designed heat exchanger 12. The inclination of the axial fan 16 supports the low-loss deflection of the air flow into the air outlet nozzle 102 of the outflow housing 92, which defines an air outlet opening 104 and is arranged laterally offset from a center plane 106 which is aligned coaxially with the axis of rotation 28. This is particularly evident from FIG. 7. The volume flow of the conveyed air from the axial fan 16 increasing linearly in the circumferential direction is received by means of the expansion of the internal volume of the outflow housing 92 via the side wall 94 continuously expanding with increasing distance from the axial fan 16, and the rear wall 96 continuously expanding in the circumferential direction, so that a substantially constant flow velocity can be achieved despite the volume flow of the conveyed air increasing linearly in the circumferential direction.

Figure 7:
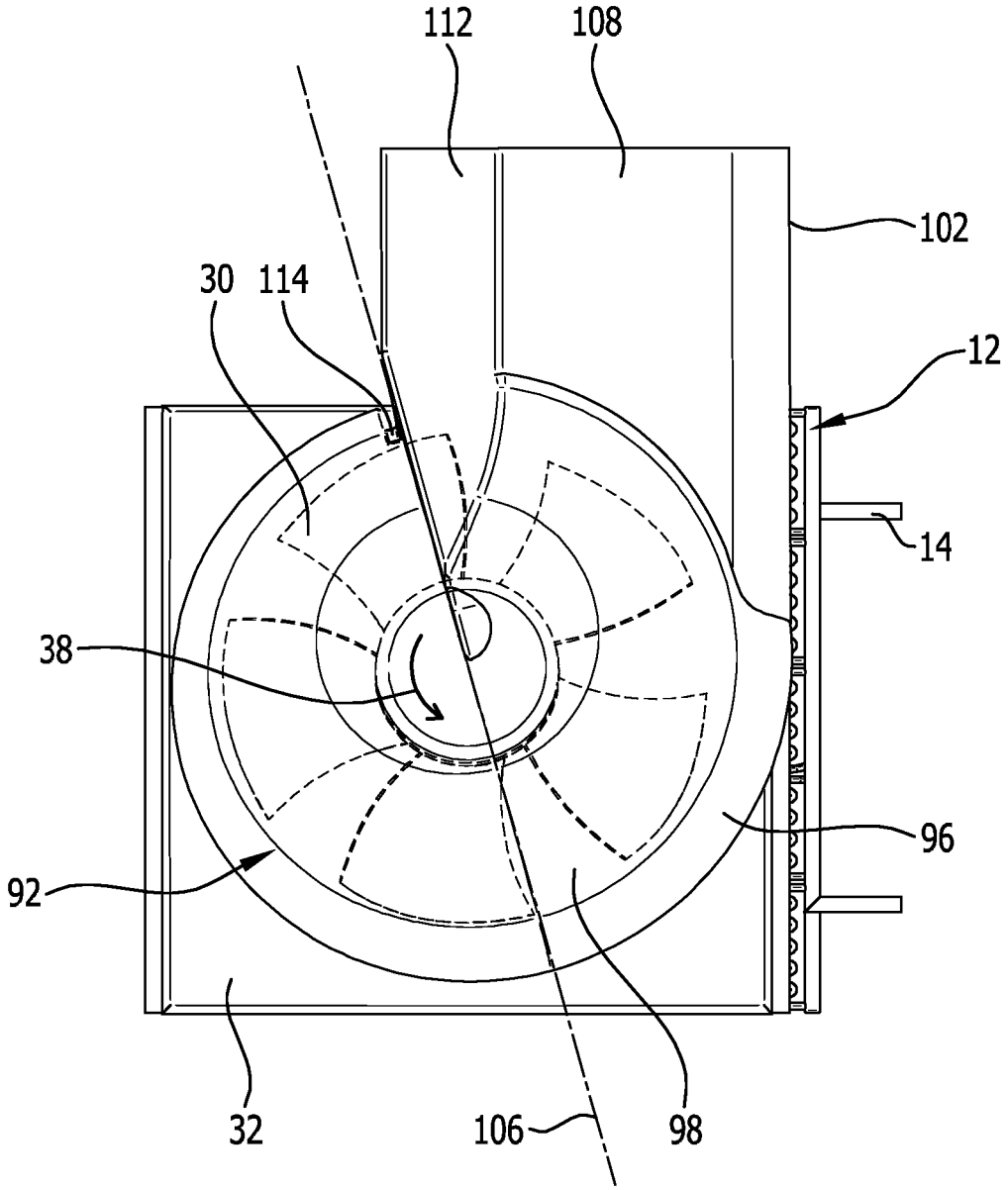
FIG. 7 shows a rear view of the device from FIG. 5.

With the device 90 as well, the blading 30 of the impeller wheel 24, in a rear view of the outflow housing 92 on the side of a center plane 106 shown in dash-dotted lines in FIG. 7, on which the air outlet nozzle 102 and the air outlet opening 104 are arranged, rotates in the direction of the air outlet nozzle, so that the air flow conveyed by the axial fan 16 can be fed to the air outlet opening 104 substantially in a tangential direction with respect to the swirling movement of the air flow. On the opposite side of the center plane 106, the air moves in a loop shape, in order to then also be fed substantially in a tangential direction to the air outlet nozzle 102 and the air outlet opening 104.

The air outlet nozzle 102 has, between a nozzle rear wall 108 facing away from the axial fan 16 and a nozzle side wall 110 facing the center plane 106, a wall flattening 112 which prevents an area with a lower flow velocity from forming in this region of the air outlet nozzle 102.

In the transition area between the rounding 96 and the air outlet nozzle 102, the outflow housing 92 has a tongue-shaped, inwardly directed flow guide element 114 which ensures a precise separation of the discharged and the circulating volume flow, wherein the volume flow to be discharged can reach the air outlet opening 104 via the air outlet nozzle 102, and the circulating volume flow executes a loop-shaped movement about the axis of rotation 28. The separation of the discharged and circulating volume flow improves the parallel flow in the air outlet nozzle 102.

Figure 9:
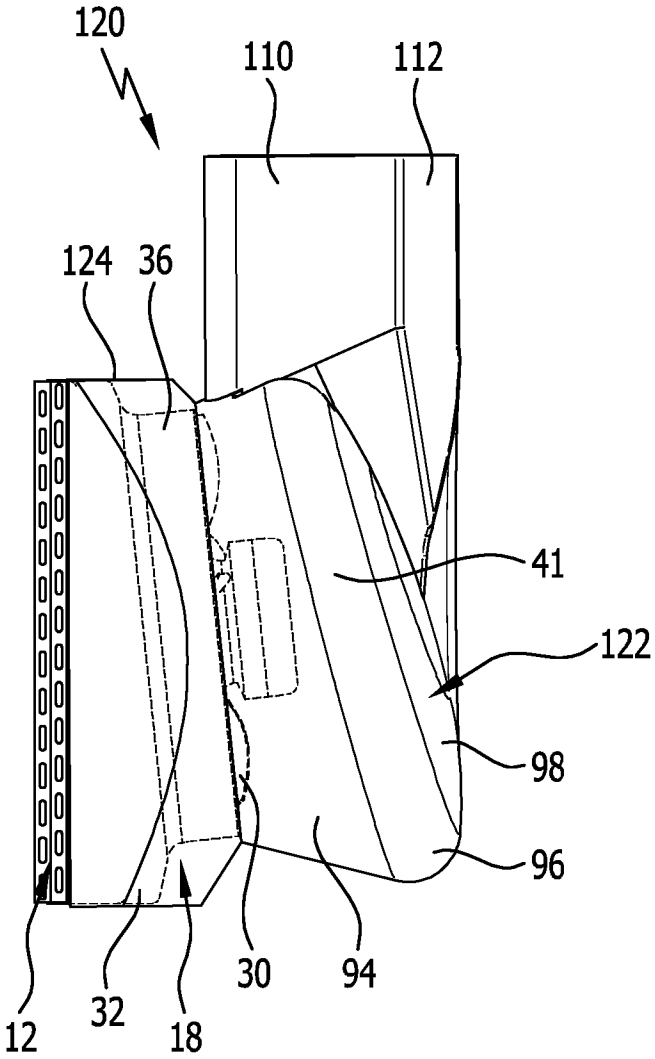
FIG. 9 shows a side view of a fourth embodiment of a device for exchanging thermal energy with the ambient air.
Figure 8:
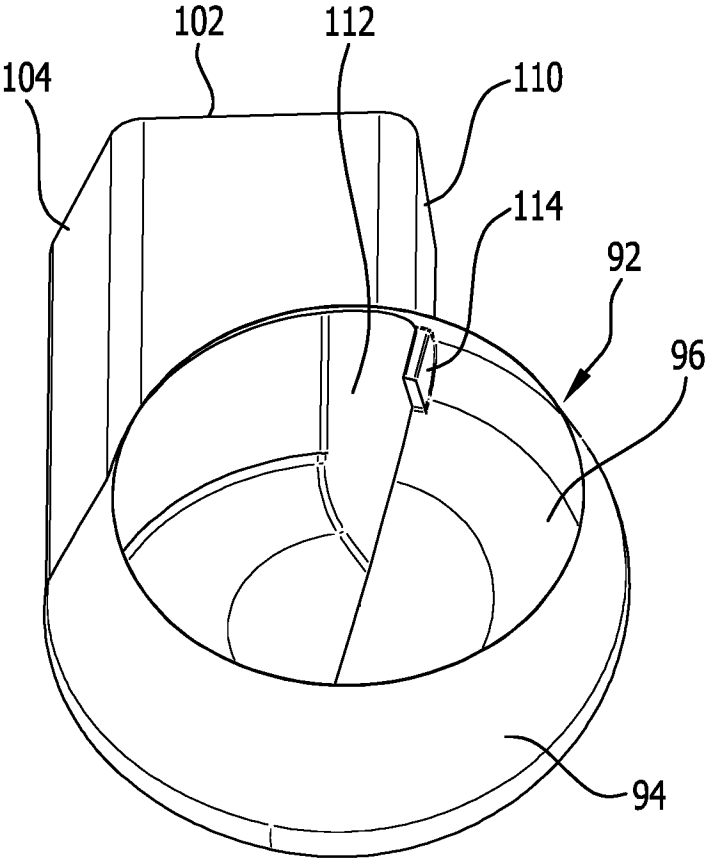
FIG. 8 shows a perspectival view of an outflow housing of the device from FIG. 5 with a view of a flow inlet obliquely from below.

FIG. 9 schematically shows a fourth advantageous embodiment of a device according to the invention for exchanging thermal energy with the ambient air, wherein the device as a whole is designated by reference sign 120.

The device 120 has a hood-like outflow housing 122 which extends with a front housing section 124 to the heat exchanger 12. The front housing section 124 surrounds the fan housing 18, wherein, however, only a small amount of vibration is transmitted from the axial fan 16 to the outflow housing 122; instead, vibrations of the axial fan 16 are primarily absorbed by the heat exchanger 12.

With the exception of the front housing section 124, the outflow housing 122 is designed in the same way as the outflow housing 92 explained above, so that reference can be made to the above explanations in this regard.

Figure 11:
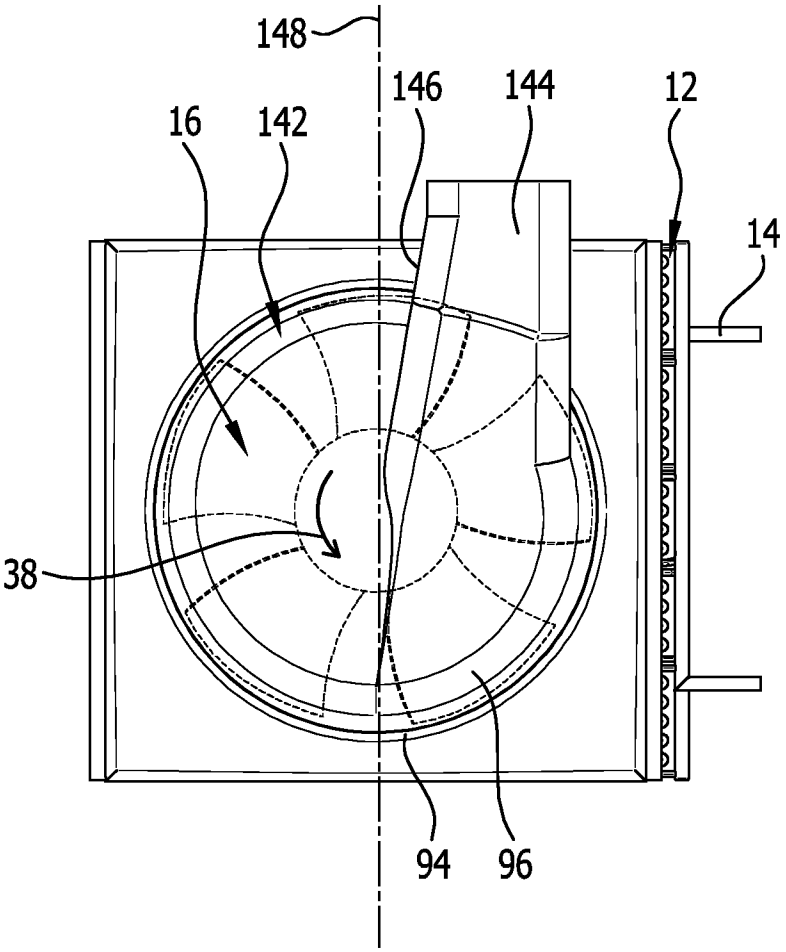
FIG. 11 shows a rear view of the device of FIG. 10.
Figure 10:
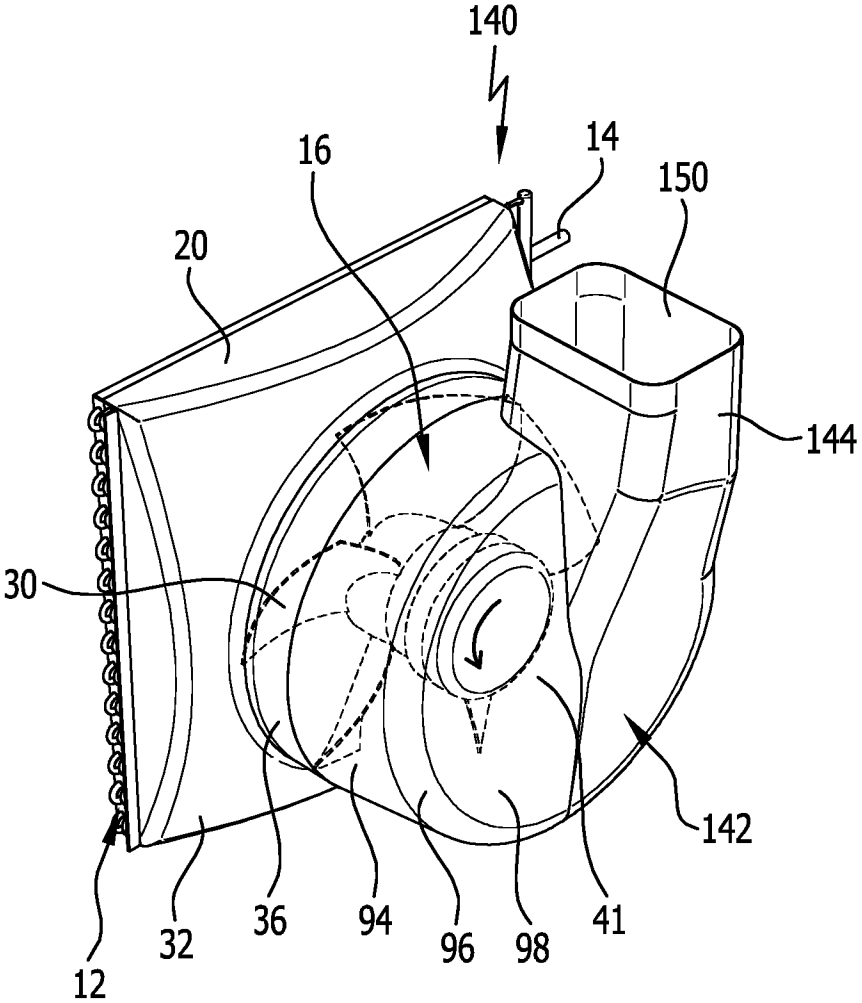
FIG. 10 shows a perspectival view of a fifth embodiment of a device for exchanging thermal energy with the ambient air.

FIGS. 10 and 11 schematically show a fifth advantageous embodiment of a device according to the invention for exchanging thermal energy with the ambient air, wherein the device as a whole is provided with reference sign 140. The device 140 has a hood-like outflow housing 142 which is designed largely identically to the outflow housing 92 explained above with reference to FIG. 5 to 8. In contrast to the outflow housing 92, the outflow housing 142 has an air outlet nozzle 144 with a nozzle side wall 146 which is inclined to a center plane 148 aligned coaxially with the axis of rotation 28 so that the flow cross-section of the air outlet nozzle 144 is reduced in the flow direction, and the flow velocity of the air flow in the air outlet nozzle 144 is thereby increased. The air outlet nozzle 144 defines an air outlet opening 150 which, like the air outlet nozzle 144, is arranged laterally offset from the center plane 148 as already explained above.

The extension of the air outlet opening 150 transverse to the axis of rotation 28 is smaller than the outer radius of the impeller wheel 24, so that a nozzle effect is created, and the air flow conveyed by the axial fan 16 is ejected out of the air outlet opening 150 at a considerable flow velocity.

Figure 12:
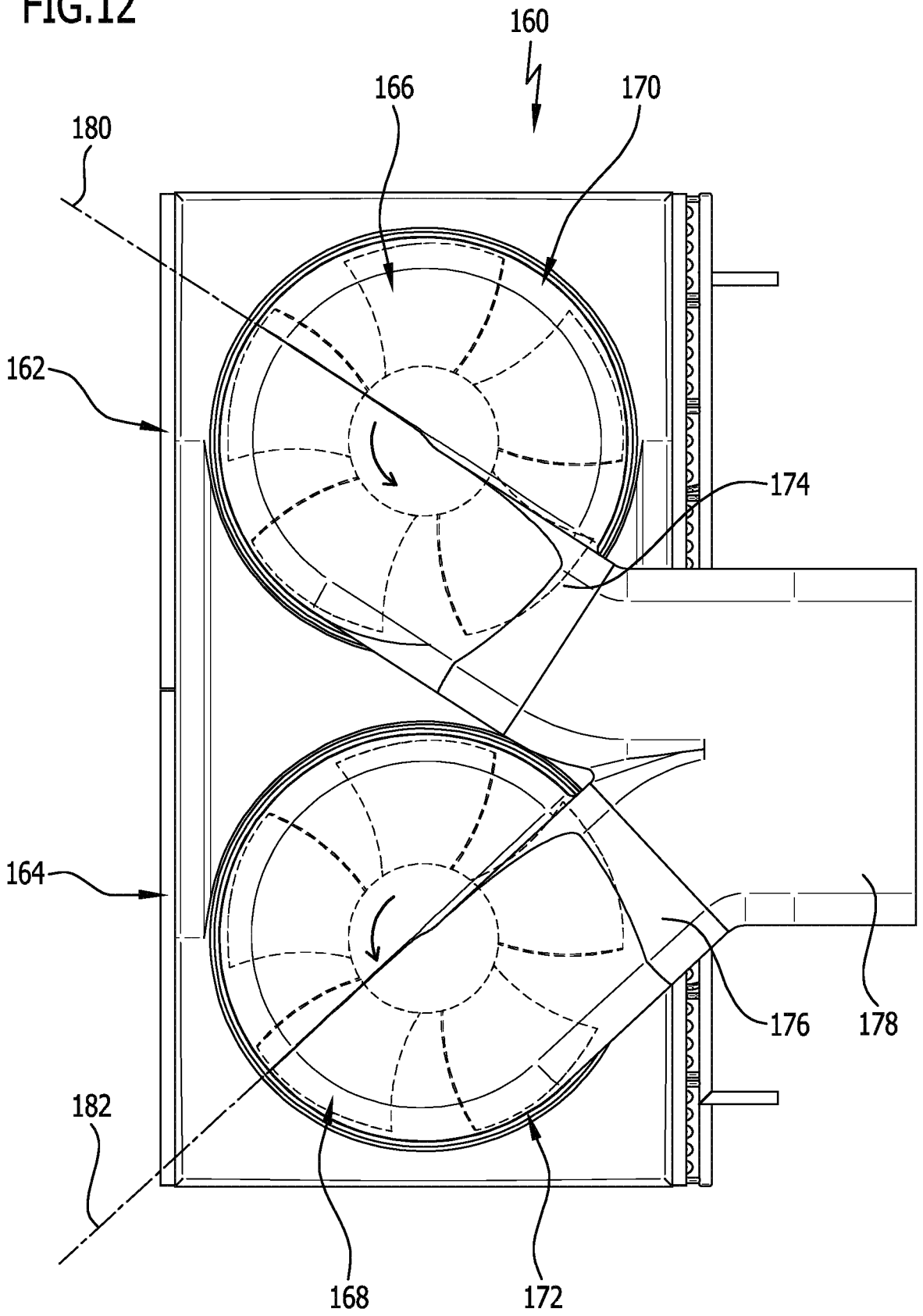
FIG. 12 shows a rear view of a sixth embodiment of a device for exchanging thermal energy with the ambient air.

FIG. 12 schematically shows a sixth advantageous embodiment of a device according to the invention for exchanging thermal energy with the ambient air. The device as a whole is designated by reference sign 160.

The device 160 has a first heat exchanger 162 and a second heat exchanger 164 which are arranged one above the other and to which an axial fan 166 or 168 and a hood-like outflow housing 170 or 172 are each assigned. The two heat exchangers 162, 164 are designed identically, and the two axial fans 166, 168 are designed identically, as are the two outflow housings 170, 172. The two outflow housings 170, 172 each have an air outlet nozzle 174 or 176 which opens into a common air outlet channel 178 via which the air flows conveyed by the two axial fans 166, 168 are discharged to the environment. The identically designed axial fans 166, 168 each have a center plane 180 or 182, shown in dash-dotted lines in FIG. 12, to which the air outlet nozzles 174, 176 are arranged offset as already explained in detail above. With reference to the rear view of the device 160 shown in FIG. 12, the axial fans 166, 168 differ only in their rotational position relative to the respective fan axis of rotation, so that the air flows can be fed to the common air outlet channel with low flow losses.

Figure 13:
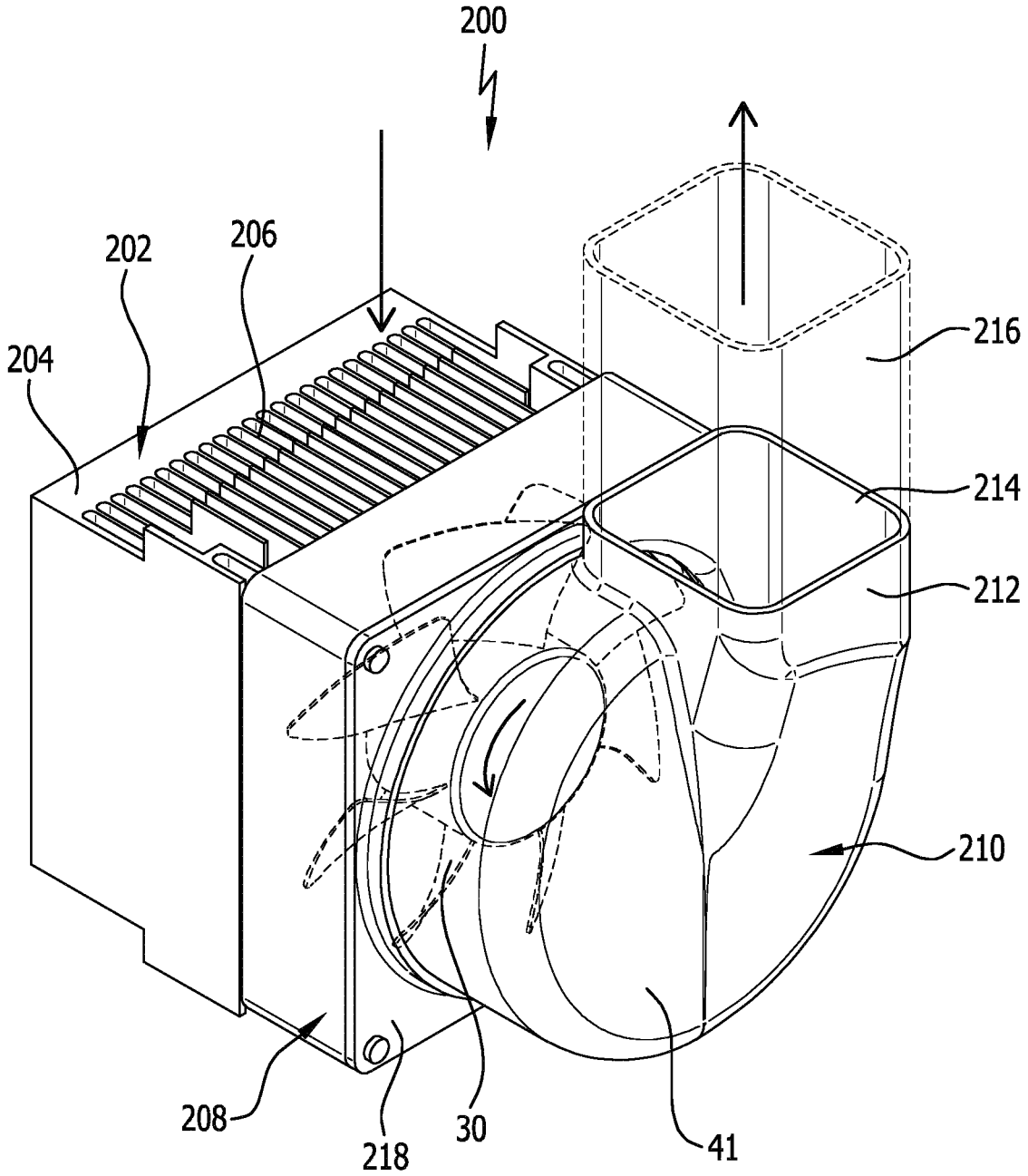
FIG. 13 shows a perspectival view of a seventh embodiment of a device for exchanging thermal energy with the ambient air.

FIG. 13 schematically shows a seventh advantageous embodiment of a device according to the invention for exchanging thermal energy with the ambient air, wherein the device is designated by reference sign 200.

The device 200 differs from the embodiments explained above essentially in that it has a heat exchanger 202 in the form of a heat sink 204. The heat sink 204 has fins 206 and serves to cool electronic components. An air flow can flow through the heat sink 18 and is conveyed by an axial fan 208 of the device 200 and fed to a hood-like outflow housing 210 of the device 200. In the outflow housing 210, the air flow is deflected by 90°, as already explained in detail above, and can be discharged via an air outlet nozzle 212 and an air outlet opening 214 to the environment or to an air channel 216 adjoining the air outlet nozzle 212. The air channel 216 is shown in dashed lines in FIG. 13.

The axial fan 208 is connected on the downstream side to a base plate 218, which enables the outflow housing 210 to be mounted so as to be rotatable about the axis of rotation of the axial fan 208, so that the outflow housing 210 can assume a predeterminable rotational position in which the air outlet nozzle 212 assumes a desired orientation.

In the outflow housing 210, the air outlet nozzle 212 and the air outlet opening 214 are also aligned offset from a center plane which is coaxial with the fan axis of rotation as already explained in detail above. The device 200 also enables an energy-efficient exchange of thermal energy with the ambient air, wherein the air flow conveyed by the axial fan 208 can be deflected by 90° with low flow losses.

The invention claimed is:

1. A device for exchanging thermal energy with ambient air, the device comprising:

a plurality of heat exchangers through which an air flow flows, each of the heat exchangers being assigned an axial fan and an outflow housing;

the axial fan being configured to convey the air flow through the heat exchangers, respectively, the axial fan having a motor and an impeller wheel with a blade which is driven by the motor to rotate about an axis of rotation; and the outflow housing being configured to receive the air flow conveyed by the axial fan on an outflow side of the axial fan, respectively, the outflow housing forms an air intake chamber axially offset from the impeller wheel and the motor of the axial fan, which receives the conveyed air flow over an entire cross-section of the impeller wheel and the motor and is penetrated by the axis of rotation, the outflow housing, in a rear view, covers the impeller wheel and the motor as a hood, and is configured to supply the conveyed air flow to an air outlet opening of the outlet housing with a directional component tangential to a swirling movement imposed on the air flow by the axial fan; and a common air outlet channel configured to receive the air flows conveyed by the axial fan from the air outlet opening of the outflow housing from each of the heat exchangers, the common air outlet channel being configured to discharge the air flow to the environment;

wherein the air outlet opening of the outflow housing of each of the heat exchangers are aligned obliquely to one another.

2. The device according to claim 1, wherein the air outlet opening is arranged downstream of the axial fan in a region, laterally offset from a center plane of the axial fan of the outflow housing, wherein the center plane is aligned coaxially with the axis of rotation, and wherein the blade of the impeller wheel in the laterally offset region, in a rear view of the outflow housing, rotates towards the air outlet opening.

3. The device according to claim 1, wherein an extension of the air outlet opening transverse to the axis of rotation is a maximum of 1.9 times an outer radius of the impeller wheel.

4. The device according to claim 3, wherein the extension of the air outlet opening transverse to the axis of rotation is at least 0.5 times the outer radius of the impeller wheel.

5. The device according to claim 1, wherein the outflow housing has an air outlet nozzle which defines the air outlet opening.

6. The device according to claim 5, wherein the air outlet nozzle widens or tapers in a direction of the air flow.

7. The device according to claim 1, wherein the outflow housing has a rear wall opposite the axial fan, which has at least one rear wall section inclined to the axis of rotation over which a distance of the rear wall to the axial fan increases.

8. The device according to claim 1, wherein the outflow housing has a side wall running in a circumferential direction.

9. The device according to claim 8, wherein the side wall widens with increasing distance from the axial fan.

10. The device according to claim 8, wherein the side wall continuously merges into a rear wall of the outflow housing by way of a rounding.

11. The device according to claim 10, wherein the rear wall widens spirally in the circumferential direction.

12. The device according to claim 1, wherein the axial fan has a fan housing which defines an inflow channel and an outflow channel, wherein the inflow channel is arranged upstream of the impeller wheel, and the outflow channel surrounds the impeller wheel in a circumferential direction.

13. The device according to claim 12, wherein the inflow channel extends to a bulkhead which has an opening to which the outflow channel is connected.

14. The device according to claim 13, wherein the outflow channel forms a constriction, adjacent to an opening of the bulkhead, to which an annular wall is connected.

15. The device according to claim 13, wherein the outflow housing is adjacent to the bulkhead and surrounds the outflow channel in the circumferential direction.

16. The device according to claim 1, wherein each of the heat exchangers are flat, and the axis of rotation is aligned obliquely to each of the heat exchangers, respectively.

17. The device according to claim 16, wherein the axis of rotation is aligned at a maximum angle of 30° to a surface normal of each of the heat exchangers, respectively.

18. The device according to claim 1, wherein the outflow housing has a flow guide element directed inwards with respect to the axis of rotation and arranged in a transition region between an air outlet nozzle and a rounding of the outflow housing.

19. The device according to acclaim 1, wherein the outflow housing is mounted on a base plate of the axial fan so as to be rotatable about the axis of rotation.

20. A use of the device according to claim 1 in a heat pump, an air conditioning system or for cooling electronic components.

* * * * *